US006038758A

United States Patent [19]

Kanai et al.

[11] Patent Number: 6,038,758

[45] **Date of Patent: *Mar. 21, 2000**

[54] PRODUCTION METHOD OF A SPINNING RING FOR A RING SPINNING MACHINE

[75] Inventors: Hiroaki Kanai, Ashiya; Kiyohide Yagyu, Amagasaki; Akira Maruta, Kameoka; Kouji Sasahara, Itami; Tsugio Shiomi, Takarazuka, all of Japan

[73] Assignee: Kanai Juyo Kogyo Co., Ltd., Itami, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,830

[22] Filed: Apr. 17, 1997

[30] Foreign Application Priority Data

Oct. 31, 1996 [JP] Japan ..... 8-307209
Dec. 25, 1996 [JP] Japan ..... 8-357013

[51] Int. Cl.[7] ..... B23P 13/04

[52] U.S. Cl. ..... 29/557; 72/91; 72/105

[58] Field of Search ..... 29/557; 72/91, 72/92, 101, 105, 106

[56] References Cited

U.S. PATENT DOCUMENTS 2,128,614 8/1938 Kobayashi .
4,016,739 4/1977 Lapin et al. ..... 72/105
4,869,088 9/1989 Kadotani ..... 72/105

FOREIGN PATENT DOCUMENTS 0292616 8/1991 Denmark ..... 72/105
0844587 7/1952 Germany ..... 72/105
692399 6/1953 United Kingdom .

OTHER PUBLICATIONS

H. Mikiyo, Japan Abstract 63 249724, Production of composite ring for spinning, Oct. 17, 1988.
I. Chihiro, Japan Abstract 06 335832, Housing for Lathe, Dec. 6, 1994.

*Primary Examiner*—David P. Bryant
*Assistant Examiner*—Jermie E. Cozart
*Attorney, Agent, or Firm*—Browdy and Neimark

[57] ABSTRACT

A spinning ring for a ring spinning machine is produced by clamping and pressing a ring-like steel blank by a mandrel and a forming roll, pressing and deforming the blank by cold rolling, causing the blank to fluidize in, and fill, the gap between both machining surfaces of the forming roll and the mandrel, and rolling the blank in the direction of thickness and so expanding its diameter into a predetermined size. To prevent crack, a ring-like blank whose portion having a large machining quantity is in advance machined to a smaller thickness by machining means such as forging, cutting and rolling is preferably used. Since this production method does not essentially remove the material, the yield of the material is high, and because the number of production steps is less, the production cost can be reduced. Because the spinning ring for a ring spinning machine so produced is free from scratch and cutting trace on the surface of the product, particularly on the inner peripheral surface of a ring flange coming into contact with a traveller, the wear resistance of the traveller can be improved. Further, because a cut portion of a metal flow does not develop on the running surface of the traveller, the fatigue resistance of the spinning ring can be improved.

6 Claims, 5 Drawing Sheets

PRODUCTION METHOD OF A SPINNING RING FOR A RING SPINNING MACHINE

BACKGROUND OF THE INVENTION

1. Field of the Invention

This invention relates to a production method of a spinning ring for a ring spinning machine for integrally forming a ring flange portion, a neck portion, a support flange portion and a fit-in portion of a ring for a ring spinning machine for use in ring spinning machinery such as a ring spinning frame and a ring twisting frame, by cold rolling.

2. Description of the Prior Art

Production methods of a spinning ring for a ring spinning machine, particularly a non-reversible ring for a ring spinning machine, generally comprise the following steps (a-1) to (a-6):

(a-1): A pipe material or a round bar of a case hardening steel or a high carbon chromium bearing steel is used as a blank, and the blank is cut or hot forged into a cylindrical blank material 119 a cross-section of which is shown in FIG. 6 (blank material forming step).

(a-2): The blank material is subjected to cutting by a lathe to form a spinning ring 118 for a ring spinning machine having a predetermined shape a cross-section of which is shown in FIG. 6 (cutting step).

(a-3): Heat-treatment such as quenching and tempering is applied to the spinning ring 118 shaped into the predetermined shape described above (heat-treatment step).

(a-4): The surface of the spinning ring 118 so heat-treated is polished by barrel polishing, etc. (polishing step).

(a-5): Surface treatment such as plating and coating is applied to the surface of at least the ring flange portion of the spinning ring 118, whenever necessary (surface treatment step).

(a-6): After final inspection, the spinning ring 118 for a ring spinning machine is obtained as the product.

In the conventional production method of the non-reversible ring for a ring spinning machine comprising the steps (a-1) to (a-6), the cylindrical blank material 119 shown in FIG. 6 is produced from the pipe material or the round bar and this blank material is then subjected to cutting to form the spinning ring 118 for a ring spinning machine having the predetermined shape shown in FIG. 6. Therefore, the blank material 119 must have a sectional shape whose size can contain the sectional shape of at least the spinning ring 118 for a ring spinning machine. Therefore, the weight of the blank material 119 is about 5 to about 10 times the weight of the spinning ring 118 for a ring spinning machine, and there remains the problem that the yield of the material is extremely low.

When the round bar, in particular, is hot forged to form the cylindrical blank material 119 by these conventional production methods, the round bar is cut first into a predetermined length, is then shaped into a predetermined cylindrical shape by hot forging, and is spheroidally annealed so as to spheroidize the structure of the blank material 119. Furthermore, shot blast is carried out to remove the carburized scale formed during hot forging and to remove the black scale of the surface before obtaining the blank material 119. Therefore, there remains the problem that the production cost of the blank material 119 is extremely high.

When the non-reversible ring for a ring spinning machine is produced by these conventional production methods, the blank material 119, for example, is first clamped at one of the end portions thereof by the lathe for cutting, and under this state, the outer peripheral surface of the other end portion of the blank material 119 is cut to form a fit-in portion of the spinning ring. Next, the inner peripheral portion of the blank material 119 is cut to form the inner drum portion of the spinning ring. Thereafter, the blank material 119 is clamped once again to grip the other end portion thereof, the other portions of the blank material 119 such as the ring flange portion, the neck portion and the support flange portion are cut under this state to form the spinning ring 118 for a ring spinning machine. Accordingly, at least two production steps are necessary to form the spinning ring 118 for a ring spinning machine, and the problem remains in that the production process is complicated.

According to these conventional production methods, the outer peripheral surface of the portions which become the product are gripped. Therefore, the gripped portions are scratched and the cutting trace remains on the ring flange portion. In some cases, these scratches and cutting traces cannot be removed by the post-step, and they affect adversely the wear of a traveller.

According to these conventional production methods, further, the metal flow of the blank material 119 is cut off and this cut portion of the metal flow appears on the surface of the ring flange portion (running surface of the traveller). Therefore, the fatigue resistance drops, and life of the spinning ring for a ring spinning machine is reduced.

SUMMARY OF THE INVENTION

It is therefore an object of the present invention to improve the material yield in the production of the spinning ring for a ring spinning machine, to reduce the number of the production steps to reduce the production cost, to improve the wear resistance of the traveller by preventing the occurrence of scratches and cutting traces on the surface of the product, and to prevent the cut portion of the metal flow developing on at least the traveller running surface of the flange portion so as to improve the fatigue resistance of the spinning ring and to prolong its life.

To accomplish the objects described above, the present invention provides a production method of a spinning ring for a ring spinning machine by clamping and pressing a ring-like blank made of a steel by a mandrel and a forming roll and pressing and deforming the inner and outer peripheral surfaces of the ring-like blank by cold rolling into a ring body having a predetermined shape and equipped with a ring flange portion, characterized in that:

the forming roll is equipped around the outer periphery thereof with a machining surface corresponding to both ends of the ring body in an axial direction and to an outer peripheral portion of the ring body;

the mandrel is equipped around the outer peripheral surface thereof with machining surfaces corresponding to the inner peripheral portion of the ring body;

the ring-like blank is clamped and pressed by the mandrel and the forming roll, is pressed and deformed, and is caused to fluidize in, and fill, the gap between the machining surfaces of the outer periphery of the forming roll and the machining surfaces of the outer periphery of the mandrel to thereby form each portion of the ring body; and the ring-like blank is rolled in this instance in the direction of thickness between the machining surfaces so that the diameter of the blank is expanded and each portion of the ring body is machined into a predetermined size.

The production method of the spinning ring for a ring spinning machine according to the present invention can be applied, for example, to a non-reversible ring for a ring spinning machine. In such a case, the forming roll is equipped with a pair of radial walls on both sides of the outer peripheral surface thereof in an axial direction, a ring flange forming groove continuing from one of the radial walls, a neck forming protuberance continuing from the ring flange forming groove, a support flange forming groove continuing from the neck forming protuberance and a fit-in portion forming peripheral surface continuing from the support flange forming groove, for example. The mandrel is equipped with a ring flange forming groove cooperating with the ring flange forming groove, a neck forming step portion cooperating with the neck forming protuberance, a support flange forming protuberance cooperating with the support flange forming groove and a fit-in portion forming step portion cooperating with the fit-in portion forming peripheral surface. The ring-like blank is clamped and pressed by the mandrel and the forming roll so that the ring-like blank is first pressed and deformed from the inner peripheral surface side thereof by the support flange forming a protuberance of the mandrel and is allowed to fluidize in, and fill, the gap between the support flange forming protuberance and the support flange forming groove of the forming roll to thereby form a support flange portion. The ring-like blank is pressed and deformed subsequently and substantially simultaneously from the outer peripheral surface side thereof by the neck forming protuberance of the forming roll so that the ring-like blank is caused to fluidize in, and fill, the gap between the neck forming protuberance and the neck forming step portion of the mandrel to thereby form a neck portion, one of the side end portions of the ring-like blank is clamped and pressed by the ring flange forming groove of the forming roll and the ring flange forming groove of the mandrel and is caused to fluidize in, and fill, the gap between both of the grooves to thereby form a ring flange portion, and the other side end portion of the ring-like blank is clamped and pressed substantially simultaneously by the fit-in portion forming peripheral surface of the forming roll and the fit-in portion forming step portion of the mandrel and is caused to fluidize in, and fill, the gap between the peripheral surface and the step portion to thereby form a fit-in portion. Further, the ring-like blank is rolled in this instance in the direction of thickness so as to expand its diameter, and to machine the ring flange portion, the neck portion, the support flange portion and the fit-in portion into a predetermined size. Here, an annealed material which is annealed in advance and has a surface hardness of at least Hv 180 to Hv 250 is preferably used as the ring-like blank made of steel.

According to the present invention, the blank diameter is expanded by cold rolling to produce the spinning ring for a ring spinning machine, but the removal of the material is not essentially effected. Therefore, the material yield is high.

According to the present invention, further, the number of production steps may be less. Therefore, the present invention can greatly contribute to the reduction of the number of production steps and production cost.

According to the present invention, further, the spinning ring for a ring spinning machine is not essentially cut. Therefore, the scratches and the cutting traces do not occur on the product surface, particularly on the ring flange inner peripheral surface that comes into contact with the traveller. Therefore, the wear resistance of the traveller can be improved. Because the metal flow is formed continuously at the ring flange portion without being-essentially cut off, the cut portion of the metal flow does not develop on the traveller running surface, so that the fatigue resistance of the ring can be improved and the life of the ring can be improved.

When the difference of the machining quantity is excessively great between the portions of the spinning ring for a ring spinning machine, the difference occurs also in elongation of each portion in the circumferential direction. In consequence, the ring flange portion is likely to crack, or crack and breakage are likely to occur at the junction of the ring flange portion with other portions. Therefore, when the difference of the machining quantity of each portion is great, it is effective to use a blank, whose portion corresponding to the neck portion is made thinner in advance than other portions by machining means such as forging, cutting, rolling, etc., as the ring-like steel blank in the case of the non-reversible ring. In this way, the occurrence of a crack can be prevented. Therefore, in the case of the non-reversible ring, the blank whose portion corresponding to the neck portion is made thinner in advance than other portions by machining means such as forging, cutting and rolling, is used as the ring-like steel blank. Other ring-like steel blanks can also be used. For example, in the case of the non-reversible ring, a blank whose outer diameter is 50% to 70% of the support flange diameter of the spinning ring for a ring spinning machine, whose thickness is 1.1 to 2.0 times the ring flange width of the spinning ring for a ring spinning machine and whose height is 0.8 to 1.5 times the full height of the spinning ring for a ring spinning machine, can be used, too.

The above and other objects, features and advantages of the present invention will become more apparent from the following detailed description which is to be read in conjunction with the accompanying drawings.

DESCRIPTION OF THE PREFERRED EMBODIMENTS

Figure 1:
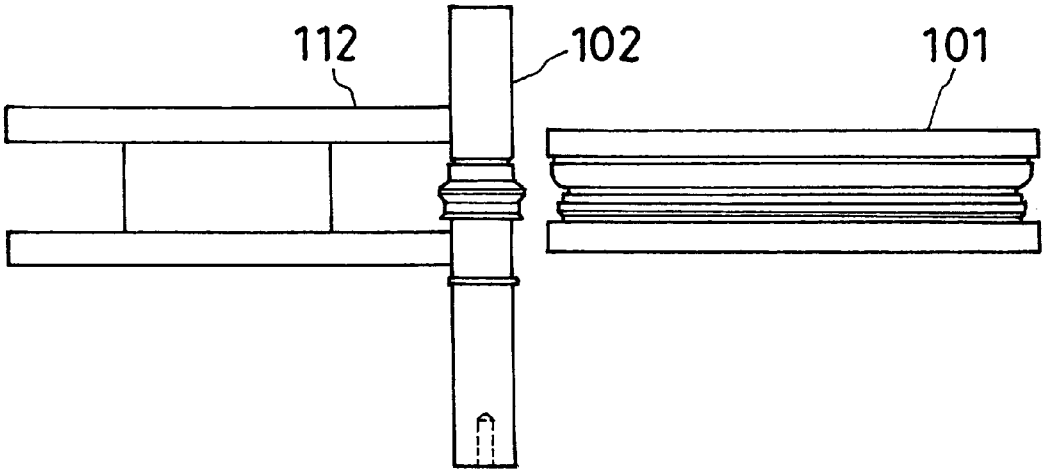
FIG. 1 is a schematic structural view showing the principal portions of an example of a cold rolling apparatus used for a production method of a non-reversible ring for a spinning machine according to the present invention.

FIGS. 1 to 5 show a preferred embodiment of a production method of a non-reversible ring for a ring spinning machine according to the present invention. In this case, a cold rolling apparatus comprises a forming roll 101 having a predetermined ring outer shape and a mandrel 102 having a predetermined ring inner shape as shown in FIG. 1. The mandrel 102 is pushed towards the forming roll 101 by a receiving roll 112 disposed at a position opposing the forming roll 101 while interposing the mandrel 102 between them.

Figure 2A:
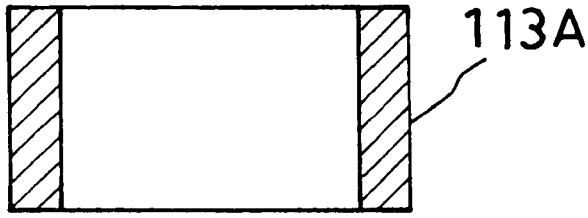
FIGS. 2(*a*)–(*c*) are sectional views of various ring-like blanks used for the production of a spinning ring for a ring spinning machine by using the apparatus shown in FIG. 1.
Figure 2B:
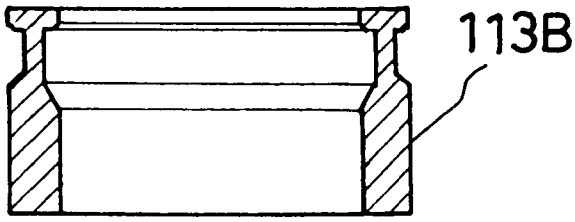
Figure 2C:
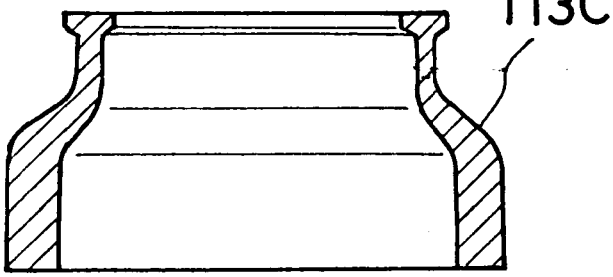

In this embodiment, ring-like blanks having various forms can be used as the ring-like blank as shown in FIGS. 2(*a*) to 2(*c*). The ring-like blank 113A shown in FIG. 2(*a*) is a cylindrical blank having a rectangular section which is obtained by cutting a steel pipe. The ring-like blank 113B shown in FIG. 2(*b*) is a cylindrical blank produced by shaping a hot rolled material by cutting, rolling, etc., and reducing the thickness of a portion corresponding to a neck portion to a smaller thickness than other portions. The ring-like blank 113C shown in FIG. 2(*c*) is a cylindrical blank produced by conducting cold rolling of the cylindrical blank shown in FIG. 2(*a*), reducing the thickness of the portion corresponding to the neck portion below the thickness of other portions, and expanding the diameters of portions corresponding to a support flange portion and a fit-in portion.

The spinning ring 117 for a ring spinning machine is produced by using the ring-like blanks 113A, 113B and 113C shown in FIGS. 2(*a*) to 2(*c*). This spinning ring 117 for a ring spinning machine forms a ring body equipped with a ring flange portion 117*a*, a neck portion 117*b* continuing from the ring flange portion 117*a*, a support flange portion 117*c* continuing from the neck portion 117*b* and a fit-in portion 117*d* continuing from the support flange portion 117*c*.

Figure 3:
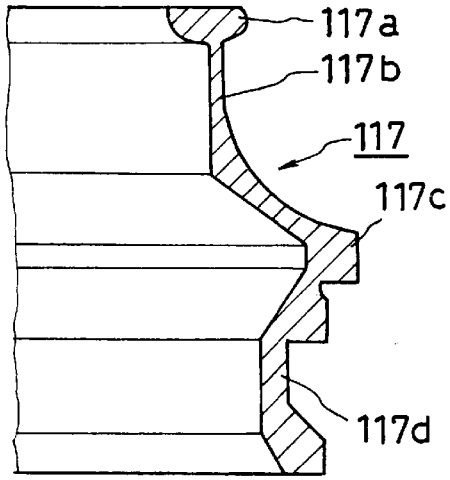
FIG. 3 is a partially exploded sectional view of a non-reversible ring for a ring spinning machine obtained by the production method using the apparatus shown in FIG. 1.
Figure 4:
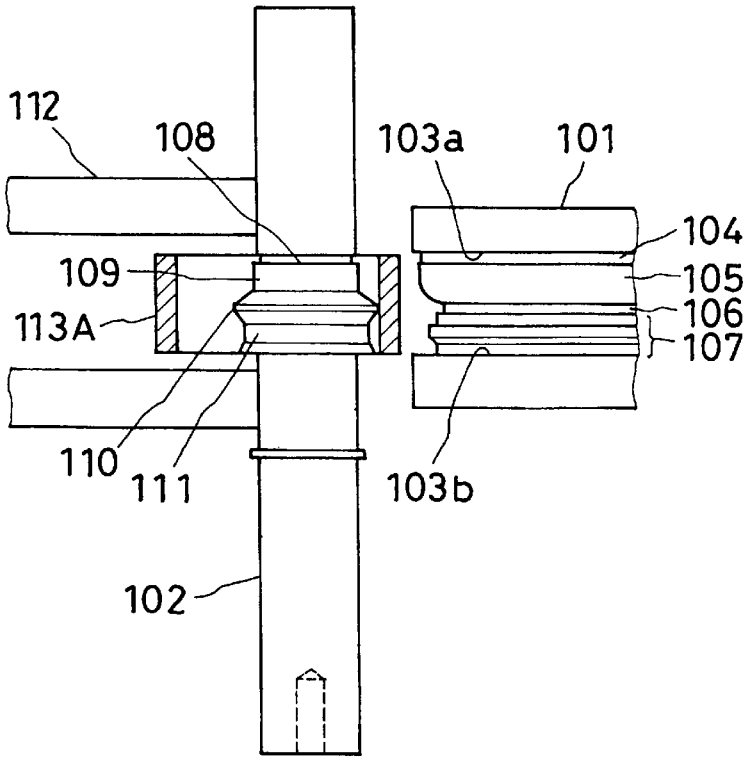
FIG. 4 is a structural view showing principal portions before the start of machining under the state where a ring-like blank is disposed on the apparatus shown in FIG. 1.
Figure 5:
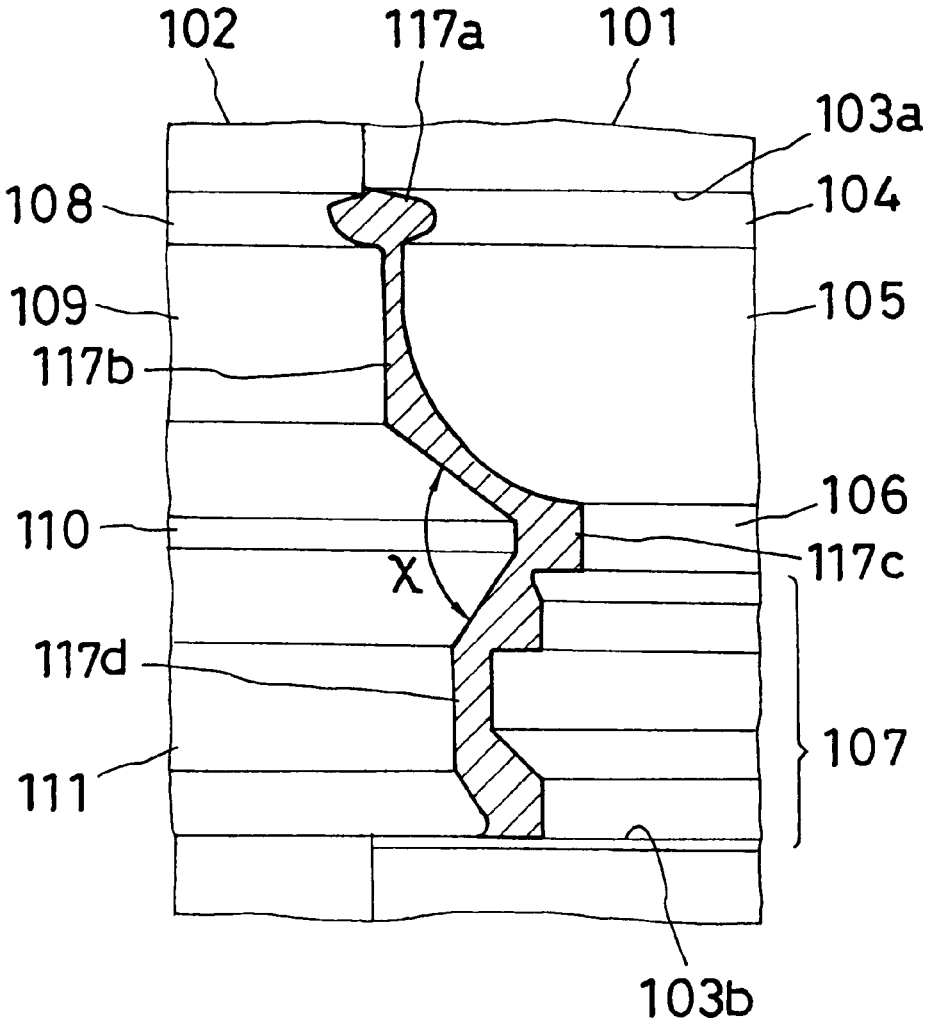
FIG. 5 is an enlarged view showing principal portions under the state where machining is completed by cold rolling the blank in the state shown in FIG. 4.
Figure 6:
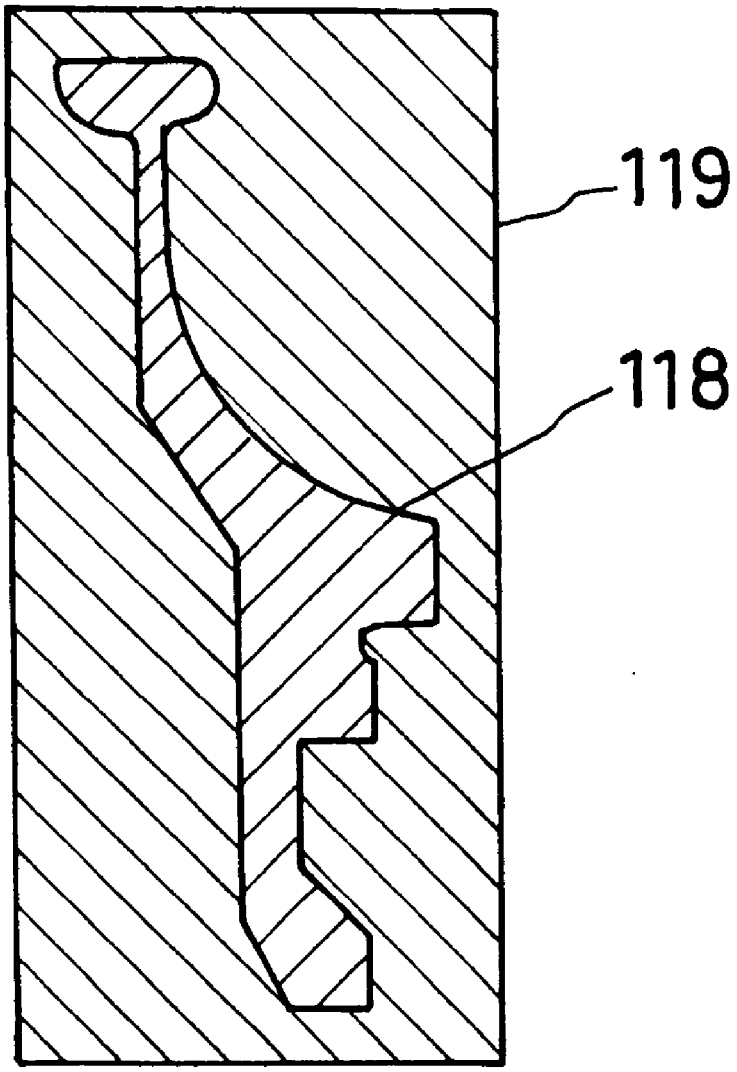
FIG.6 PRIOR ART
FIG. 6 is a partially exploded sectional view showing the relation between a non-reversible ring for a ring spinning machine according to the prior art and its blank material.

FIG. 4 shows the state before the start of machining where the ring-like blank 113A is disposed at a machining portion of a cold rolling machine when the spinning ring 117 for a spinning machine shown in FIG. 3 is produced by using the ring-like blank 113A shown in FIG. 2(*a*). As shown in this drawing, the ring-like steel blank 113A having a rectangular section is disposed in such a fashion that it is put over the mandrel 102, its inner peripheral surface opposes the mandrel 102 and its outer peripheral surface opposes the forming roll 101. From this state, the forming roll 101 is rotated, brought close to the mandrel 102 and pushed to the outer peripheral surface of the ring-like blank 113A while the receiving roll 112 is kept rotated. In consequence, the mandrel 102 rotates and the ring-like blank 113A is clamped and pressed between the mandrel 102 and the forming roll 101 and is shaped into the ring-like body equipped with the ring flange portion 117*a*, the neck portion 117*b*, the support flange portion 117*c* and the fit-in portion 117*d* as shown in FIG. 5. After shaping of the ring flange portion 117*a*, the neck portion 117*b*, the support flange portion 117*c* and the fit-in portion 117*d* is completed in this way, the forming roll 101 is moved back and the ring body shaped into a predetermined shape is withdrawn. Incidentally, the cold rolling apparatus may be of such a type that brings the receiving roll 112 into contact with the mandrel 102 without rotating it and brings the ring-like blank 113A into contact with the forming roll 101 rotating at a fixed position so as to clamp and press it.

Finish machining such as cutting is applied, whenever necessary, to the upper surface of the ring flange portion 117*a* and to the lower surface of the fit-in portion 117*d* in the ring body so machined. Furthermore, after sized machining treatment and adjustment of roundness, heat-treatment is carried out and then surface hardening treatment is effected to provide the spinning ring 117 for a ring spinning machine shown in FIG. 3.

Incidentally, it is further possible to apply polishing to the surface of at least the ring flange portion 117*a* of the spinning ring 117 for a ring spinning machine by machining means such as barrel polishing and buff polishing or to apply surface treatment such as plating, coating, metal diffusion coating, etc., so as to improve the wear resistance.

As shown in FIGS. 4 and 5, the forming roll 101 is equipped with a pair of radial walls 103*a* and 103*b* at both end portions of the outer peripheral surface thereof in the axial direction. A ring flange forming groove 104 is so formed on the outer peripheral surface of the forming roll 101 as to continue from one 103*a* of the radial walls, a neck forming protuberance 105 is so formed as to continue from the ring flange forming groove 104, a support flange forming groove 106 is so formed as to continue from the neck forming protuberance 105 and furthermore, a fit-in portion forming peripheral surface 107 is so formed as to continue from the support flange forming groove 106.

As shown in FIGS. 4 and 5, the mandrel 102 is equipped with a ring flange forming groove 108 which cooperates with the ring flange forming groove 104 of the forming roll 101, a neck forming step portion 109 which cooperates with the neck forming protuberance 105 of the forming roll 101, a support flange forming protuberance 110 which cooperates with the support flange forming groove 106 of the forming roll 101 and a fit-in portion forming step portion 111 which cooperates with the fit-in portion forming peripheral surface 107 of the forming roll 101.

The sectional shape of the support flange forming protuberance 110 of the mandrel 102 is a wedge shape having an included angle X of 90° as shown in FIG. 5, and a flat surface is formed at its distal end. The included angle X of this wedge shape may be from 80° to 95°, and the distal end portions may be connected by a curved surface.

The shape of the outer peripheral surface of the forming roll 101 and the shape of at least the ring flange forming groove 108 of the mandrel 102 are profiled substantially accurately into the shape of the spinning ring for a ring spinning machine to be formed.

Next, the machining method of the non-reversible ring for a ring spinning machine by using the cold rolling apparatus equipped with the forming roll 101 and the mandrel 102 described above will be explained.

The cylindrical ring-like blank 113A having a rectangular sectional shape and shown in FIG. 2(*a*), for example, is used as the ring-like blank, and is put over and disposed at the machining portion of the mandrel 102. While the receiving roll 112 is kept rotated, the forming roll 101 is rotated and brought close to the mandrel 102 and is pushed to the outer peripheral surface of the ring-like blank 113A.

Due to the rotation and the pushing operation of the forming roll 101 and to the rotation of the mandrel 102, the ring-like blank 113A is clamped and pressed by the mandrel 102 and the forming roll 101, and its inner and outer peripheral surfaces are profiled into the predetermined outline of the spinning ring for a ring spinning machine by the ring flange forming groove 104, the neck forming protuberance 105, the support flange forming groove 106 and the fit-in portion forming peripheral surface 107 of the forming roll 101 in cooperation with the ring flange forming groove 108, the neck step portion 109, the support flange forming protuberance 110 and its fit-in portion forming step portion 111 of the mandrel 102. At the same time, the thickness of the ring-like blank 113A is reduced, and the diameter of the blank is expanded as a whole simultaneously. In this way, the blank is formed into the shape of the ring body equipped with the ring flange portion 117*a*, the neck portion 117*b*, the support flange portion 117*c* and the fit-in portion 117*d* shown in FIG. 5.

After shaping of the ring flange portion 117*a*, the neck portion 117*b*, the support flange portion 117*c* and the fit-in portion 117*d* is completed in this way, the forming roll 101 is moved back and the ring body shaped into the predetermined shape is withdrawn.

Finish machining such as cutting is applied, whenever necessary, to the upper surface of the ring flange portion 117*a* of the ring body so shaped and to the lower surface of its fit-in portion 117*d*. After sized machining and adjustment of roundness are carried out further, the heat-treatment and the surface hardening treatment are conducted to provide the spinning ring 117 for a ring spinning machine shown in FIG. 3. Polishing is applied to the surface of at least the ring flange portion 117*a* of the spinning ring 117 for a ring spinning machine by machining means such as barrel polishing and buff polishing and surface treatment such as plating, coating or a metal diffusion coating is applied so as to improve the wear resistance.

According to the machining method described above, the ring-like blank 113A is pushed and deformed from its inner peripheral surface side by the support flange forming protuberance 110 of the mandrel 102 at the initial stage of cold rolling. Next, it fluidizes in, and fills, the gap between the forming roll 101 and the support flange forming groove 106 and forms the support flange portion 117*c*.

Simultaneously substantially, the ring-like blank 113A is pushed and deformed from its outer peripheral surface side by the neck forming protuberance 105 of the forming roll 101, and is plasticised and fluidized in the circumferential direction. While the diameter of the blank 113A is expanded and its thickness is reduced, the ring-like blank 113A fluidizes in, and fills, the gap with the neck step portion 109 of the mandrel 102 and forms the neck portion 117*b*.

Substantially simultaneously, one of the side end portions of the ring-like blank 113A is clamped and pressed by the ring flange forming groove 104 of the forming roll 101 and the ring flange forming groove 108 of the mandrel 102 and is plasticised and fluidized. The blank 113A fluidizes in, and fills, the gap between both grooves 104 and 108, and forms the flange portion 117*a*.

Substantially simultaneously, further, the other side end portion of the ring-like blank 113A is clamped and pressed by the fit-in portion forming peripheral surface 107 of the forming roll 101 and the fit-in portion forming step portion 111 of the mandrel 102, is plasticised and fluidized, fluidizes in, and fills, the gap between the peripheral surface 107 and the step portion 111 and forms the fit-in portion 117*d*. The ring-like blank 113A is rolled in this way in the direction of thickness and is stretched in the circumferential direction. As its diameter is thus expanded, the blank 113A forms the ring flange portion 117*a*, the neck portion 117*b*, the support flange portion 117*c* and the fit-in portion 117*d* each having a predetermined size, and is machined into the spinning ring 117 for a ring spinning machine having a predetermined shape and a predetermined size.

It is advisable to use an annealed material which is annealed in advance and has a hardness of from Hv 180 to Hv 250 as the ring-like blank of the steel described above. Preferably, its outer diameter is 50% to 70% of the support flange diameter of the spinning ring for a ring spinning machine, its thickness is 1.1 to 2.0 times the ring flange width of the spinning ring for a ring spinning machine, and its height is 0.8 to 1.5 times the total height of the spinning ring for a ring spinning machine.

In the embodiment described above, the shape of the spinning ring for a ring spinning machine is finished in one process step. When the difference between the machining quantity of the ring flange portion and that of the neck portion is too great, however, a difference occurs in elongation of each portion in the circumferential direction, and the ring flange portion is likely to crack. Therefore, it is also possible to produce the spinning ring for a ring spinning machine in two process steps so as to reduce the difference of the respective machining quantities. In other words, the ring-like blanks 113B and 113C shown in FIGS. 2(*b*) and 2(*c*), the thickness of which at the portion thereof corresponding to the neck portion is reduced in advance to below those of other portions by machining means such as forging, cutting and rolling can be used, too.

It is advisable to use an annealed material which is annealed in advance and has a hardness of Hv 180 to Hv 250 as the steel ring-like blank described above.

It should be understood that we intend to cover by the appended claims all modifications falling within the true spirit and scope of our invention.

What is claimed is:

1. A production method for making a non-reversible spinning ring, having a shape which is dissymmetric in the direction of an axis thereof, by clamping and pressing a ring blank made of steel between a mandrel and a forming roll;

wherein an inner and an outer peripheral surface of said ring blank is deformed by cold rolling into a ring body having a ring flange portion at a first end, a neck portion continuing from said ring flange portion, a support flange portion continuing from said neck portion and a fit-in portion at a second end continuing from said support flange portion;

said forming roll having a pair of radial walls on both sides of an outer peripheral surface thereof in an axial direction, a ring flange forming groove continuing from one of said radial walls, a neck forming protuberance continuing from said ring flange forming groove, a support flange forming groove continuing from said neck forming protuberance and a fit-in portion forming peripheral surface continuing from said support flange forming groove; and said mandrel having a ring flange forming groove corresponding to said ring flange forming groove of said forming roll, a neck forming step portion corresponding to said neck forming protuberance of said forming roll, a support flange forming protuberance, the sectional shape of which is a wedge shape having an included angle of from 80° to 95°, corresponding with said support flange forming groove of said forming roll and a fit-in portion forming step portion corresponding with said fit-in portion forming peripheral surface of said forming roll; said method comprising the steps of;

clamping and pressing said ring blank in said mandrel and said forming roll so that said ring is first pressed and deformed from the inner peripheral surface thereof by said support flange forming protuberance of said mandrel wherein said ring is deformed in a gap between said support flange forming protuberance and said support flange forming groove of said forming roll;

thereafter, pressing and deforming said ring substantially simultaneously from the outer peripheral surface thereof by said neck forming protuberance of said forming roll to deform said ring in a gap between said neck forming protuberance and said neck forming step portion of said mandrel, thereafter, clamping and pressing a first side end portion of said ring by said ring flange forming groove of said forming roll and said ring flange forming groove of said mandrel to deform said ring in a gap between said ring flange forming groove of said forming roll and said mandrel, and a second end portion of said ring being clamped and pressed substantially simultaneously by said fit-in portion forming peripheral surface of said forming roll and said fit-in portion forming step portion of said mandrel to deform said ring in a gap between said fit-in portion forming peripheral surface of said forming roll and said fit-in forming step portion of said mandrel;

wherein a direction of a thickness, the diameters of said ring are expanded and deformed to fill gaps between each portion of said forming roll and said mandrel, thereby producing said ring flange portion, said neck-portion, said support flange portion and said fit-in portion into a predetermined size.

2. A production method for making a spinning ring according to claim 1, wherein material which is annealed in advance and has a surface hardness of Hv 180 to Hv 250 as said ring blank, and wherein said material is steel.

3. A production method for making a spinning ring according to claim 1, wherein a portion of the ring blank to be formed into the neck portion being made thinner in advance than other portions is performed by machining means.

4. A production method for making a spinning ring according to claim 1, wherein said ring blank has an outer diameter which is 50% to 70% of the support flange diameter of said spinning ring, a thickness which is 1.1 to 2.0 times the ring flange width of said spinning ring and a height which is 0.8 to 1.5 times the total height of said spinning ring.

5. A production method for making a spinning ring according to claim 2, wherein said ring blank has an outer diameter which is 50% to 70% of the support flange diameter of said spinning ring, a thickness which is 1.1 to 2.0 times the ring flange width of said spinning ring and a height which is 0.8 to 1.5 times the total height of said spinning ring.

6. A production method for making a spinning ring according to claim 3, wherein said ring blank has an outer diameter which is 50% to 70% of the support flange diameter of said spinning ring, a thickness which is 1.1 to 2.0 times the ring flange width of said spinning ring and a height which is 0.8 to 1.5 times the total height of said spinning ring.

* * * * *